US007237926B2

(12) United States Patent
Fan

(10) Patent No.: US 7,237,926 B2
(45) **Date of Patent: *Jul. 3, 2007**

(54) LIGHT STRING HAVING A PRINTED CIRCUIT BOARD AND USING A CLADDING TO SCATTER LIGHT FROM LIGHT EMITTING DIODES TO PRESENT A NEON LIGHT EFFECT

(76) Inventor: Ben Fan, 15th Fl., No. 81, Sec. 1, Hsintai 5th Rd., Hsitzu City, Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/268,314

(22) Filed: Nov. 7, 2005

(65) Prior Publication Data

US 2006/0056179 A1 Mar. 16, 2006

Related U.S. Application Data

(63) Continuation-in-part of application No. 10/824,142, filed on Apr. 14, 2004, now Pat. No. 7,048,413.

(51) Int. Cl.
*F21V 21/00* (2006.01)
*F21S 4/00* (2006.01)

(52) U.S. Cl. ..... 362/249; 362/217

(58) Field of Classification Search ..... 362/249, 362/246, 248, 224, 217, 219, 223–225
See application file for complete search history.

(56) References Cited

U.S. PATENT DOCUMENTS 7,048,413 B2 * 5/2006 Fan ..... 362/249

* cited by examiner

*Primary Examiner*—Ali Alavi
(74) *Attorney, Agent, or Firm*—Jackson Walker, LLP

(57) ABSTRACT

A light string includes a printed circuit board made of a soft material and having multiple axial holes defined in one side of the printed circuit board, two connection wires received in the other side of the printed circuit board to be opposite to positions of the axial holes, multiple light emitting diodes (LEDs) respectively received in the axial holes and connected to the two connection wires for electrical connection with one another, a scattering body formed on top of the printed circuit board and on top of the LEDs for scattering light beams from the LEDs and a cladding enclosing the scattering body and the printed circuit board and having an arcuate top face for emission of light beams of the LEDs. Due to the addition of the scattering body and the cladding, the light beams from the LEDs are refracted and scattered to present a soft and continuous lighting effect.

10 Claims, 12 Drawing Sheets

A–A

LIGHT STRING HAVING A PRINTED CIRCUIT BOARD AND USING A CLADDING TO SCATTER LIGHT FROM LIGHT EMITTING DIODES TO PRESENT A NEON LIGHT EFFECT

CROSS REFERENCE

This application is a continuation-in-part of the application Ser. No. 10/824,142 filed on Apr. 14, 2004, now U.S. Pat. No. 7,048,413, by the same applicant of this application. The content thereof is hereinafter incorporated.

BACKGROUND OF THE INVENTION

1. Field of the Invention

The present invention relates to a light string, and more particularly to a light string with a cladding outside the light emitting diodes (LEDs) to scatter the light from the LEDs so as to present a neon light effect.

2. Description of Related Art

With reference to FIG. 12, a conventional light string has a core (110), two wires (120,130), multiple axial holes (140) or multiple radial holes (150*a*,150*b*,150*c*,150*d*,150*e*) to receive therein multiple light emitting diodes (160*a*,160*b*, 160*c*) and connection wires (170*a*,170*b*) for interlinking each of the LEDs (160*a*,160*b*,160*c*). The LEDs (160*a*,160*b*, 160*c*) are alternately received in the radial holes (150*a*,150*b*, 150*c*,150*d*,150*e*) such that the connection wires (170*a*,170*b*) are sandwiched between two adjacent LEDs (160*a*,160*b*, 160*c*) after the connection wires (170*a*,170*b*) are alternately received in the radial holes (150*a*,150*b*,150*c*,150*d*,150*e*). A transparent cladding (180) is then formed outside the core (110).

If the light string with the core (110) has only axial holes (140) for receiving therein LEDs (160*a*,160*b*,160*c*), the light string is called the Horizontal-Type and if the light string with the core (110) has only radial holes (150*a*,150*b*,150*c*, 150*d*,150*e*), the light string is called the Vertical-Type.

U.S. Pat. No. 4,607,317 issued on Aug. 19, 1986 discloses a light string with better safety, packaging, installation, use and maintenance features than any other existing light string. However, the light string can not solve the shortcoming that the light from the LEDs is not continuous. That is, this light string still uses the LEDs as the light source without any modification to soften the dotted-effect from the LEDs.

U.S. Pat. No. 6,186,645 issued on Feb. 13, 2001 discloses a Horizontal-Type light string having the capability to scatter the light from the LEDs. However, the light from the LEDs is not sufficiently softened and thus still does not emit a soft and continuous light when compared with a neon light in the market.

U.S. Pat. No. 6,565,251 B2 issued on May 20, 2003 discloses a light string having a core and a cladding outside the core. The core and the cladding may have different shapes such as circular, square, oval or even wave-like. At least one axial space may be defined between the core and the cladding so that the at least one axial space may be filled with insulation fluid to improve the light scattering and reflection. Although this light string claims to have the capability to emit a soft and continuous light effect as that of a neon light, there is no definite structure to show how the light is reflected and/or refracted.

To overcome the shortcomings, the present invention tends to provide an improved light string to mitigate the aforementioned problems.

SUMMARY OF THE INVENTION

The primary objective of the present invention is to provide an improved light string using a cladding to scatter the light from the light emitting diodes to present a soft and continuous light.

Other objects, advantages and novel features of the invention will become more apparent from the following detailed description when taken in conjunction with the accompanying drawings.

DETAILED DESCRIPTION OF THE PREFERRED EMBODIMENT

Figure 1:
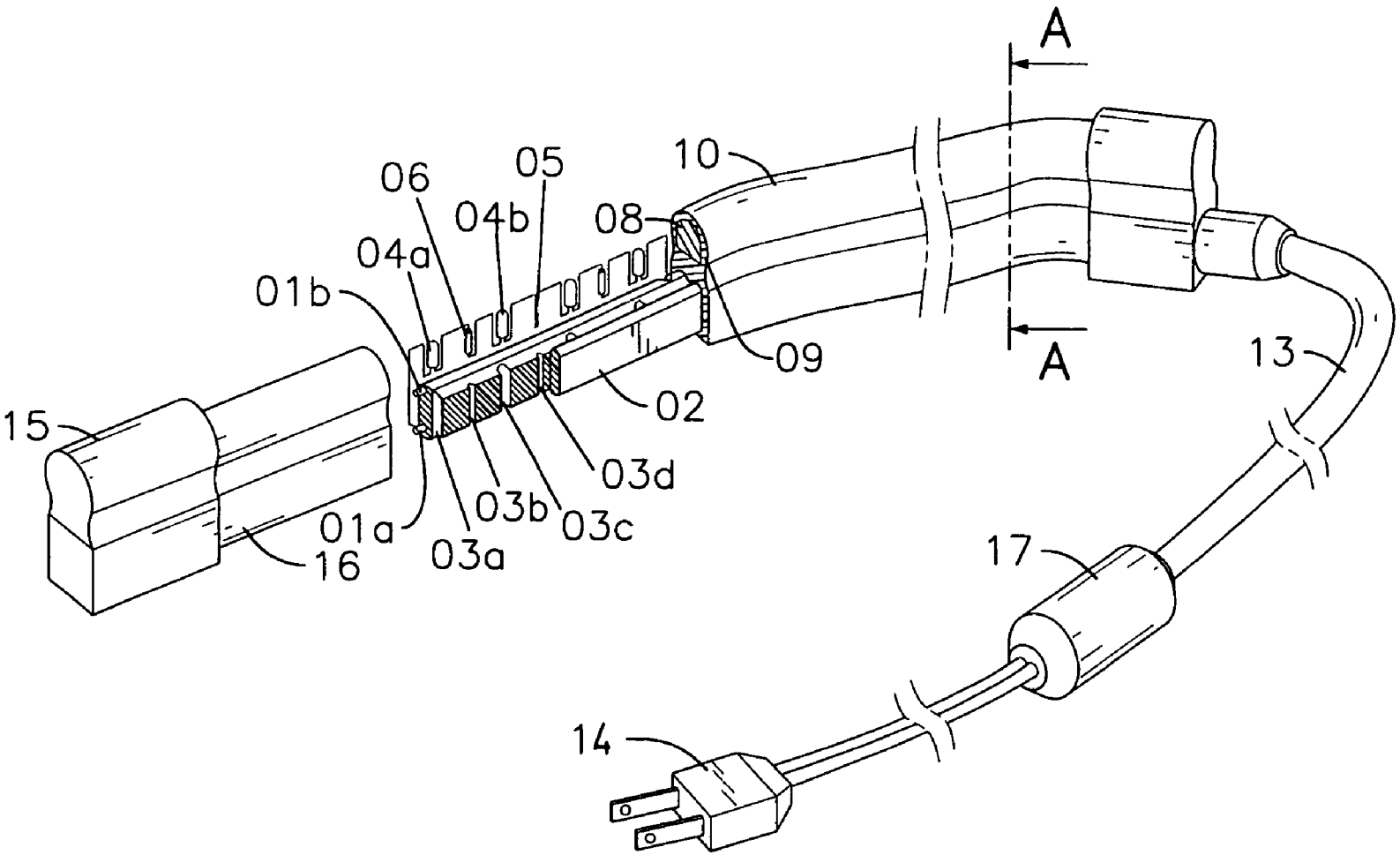
FIG. 1 is a perspective view showing the light string of the present invention.
Figure 2:
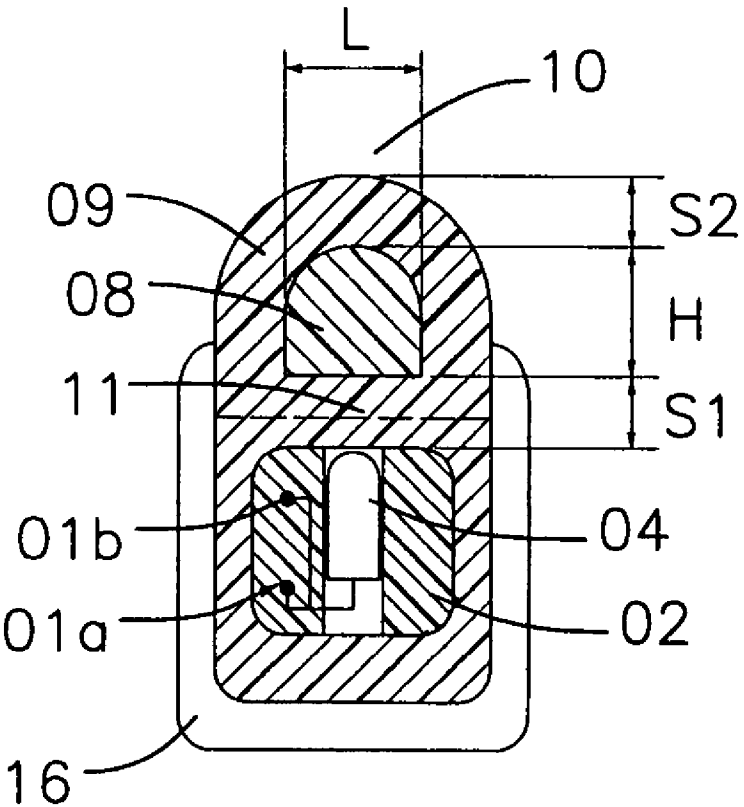
FIG. 2 is a cross sectional view showing the internal structure of the light string of the present invention.

With reference to FIGS. 1 and 2, the light string constructed in accordance with the present invention includes a printed circuit board (02), a scattering body (08) and a cladding (09) enclosing the printed circuit board (02) and the scattering body (08).

The printed circuit board (02) has multiple radial holes (03*a*,03*b*,03*c*,03*d*) defined in a side of the printed circuit board (02) to alternately receive therein light emitting diodes (LEDs) (04*a*,04*b*) and two connection wires (01*a*,01*b*) are received in the other side in the printed circuit board (02) relative to the radial holes (03*a*,03*b*,03*c*,03*d*). Because the two connection wires (01*a*,01*b*) are on one side in the printed circuit board (02) and the LEDs (04*a*,04*b*) received in the radial holes (03*a*,03*b*,03*c*,03*d*) are on the other side of the printed circuit board (02), when the light string is bent, the stretching force to either one of the two connection wires (01*a*,01*b*) is the same so that difficulty in bending the light string and breakage of the connection wires (01*a*,01*b*) are avoided.

It is to be noted that the LEDs (04*a*,04*b*) are alternately received in the radial holes (03*a*,03*c*) and thus the radial holes (03*b*,03*d*) are left to receive therein a joint (05) between two LEDs (04*a*,04*b*) and a resistor (06).

Figure 3:
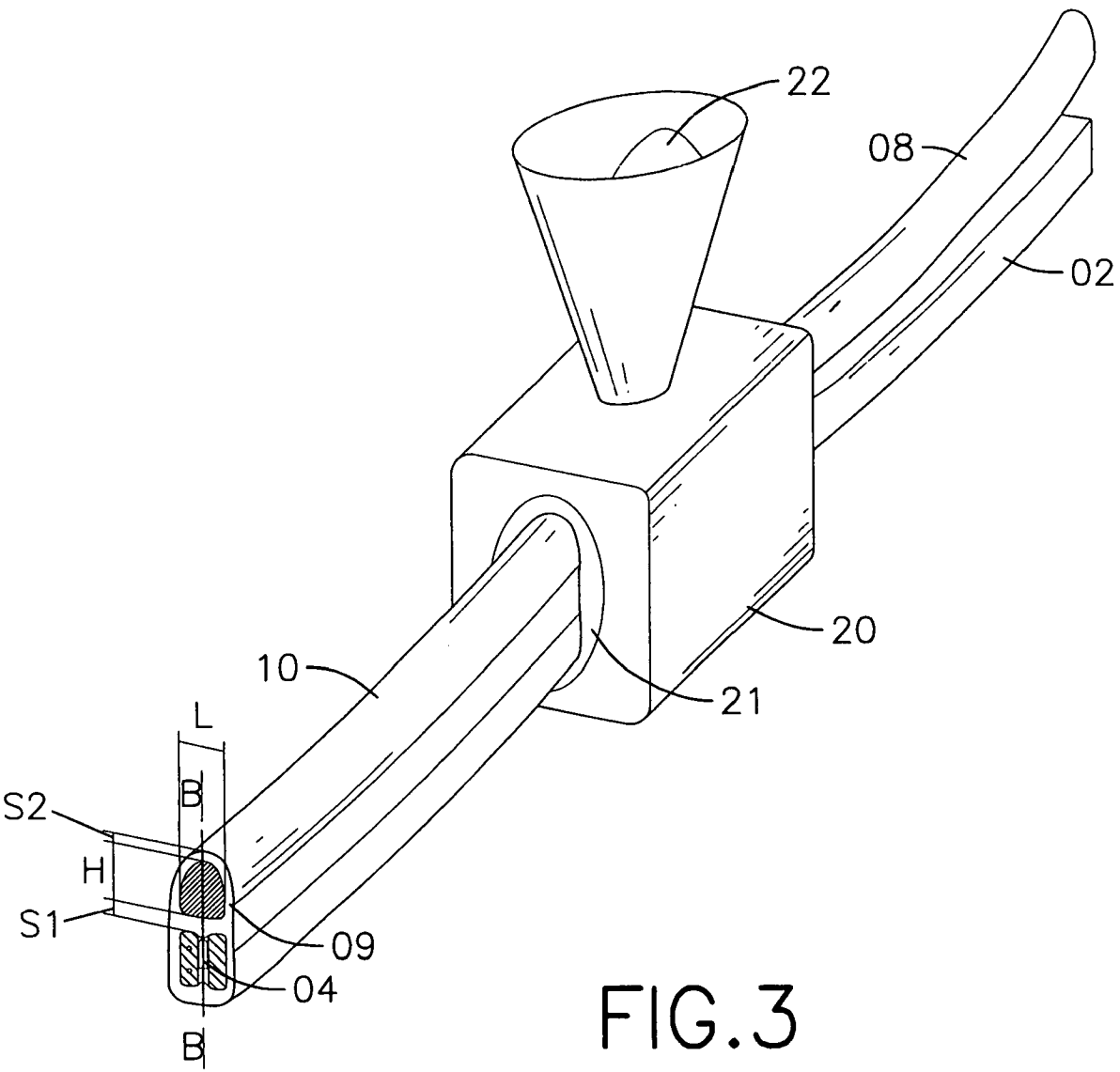
FIG. 3 is a schematic perspective view showing the formation of a cladding outside the printed circuit board and the scattering body on top of the printed circuit board.

After the LEDs (04*a*,04*b*) are received in the radial holes (03*a*,03*c*) in the printed circuit board (02), the printed circuit board (02) passes through a through hole (21) in extruding machine (20) with a scattering body (08) which is made of a lacteous material, as shown in FIG. 3. A soft material, e.g. PVC, (22) enters the extruding machine (20) and encloses the printed circuit board (02) and the scattering body (08) to form a cladding (09) outside the scattering body (08) and the printed circuit board (02). The cladding (09) has an arcuate top face (10) on top of the scattering body (08) and the LEDs (04*a*,04*b*). Furthermore, the LEDs (04*a*,04*b*) are located below the scattering body (08) and preferably below the center line B—B of the scattering body (08).

It is noted from the teaching that the width and height of the scattering body (08) are proportional to the brightness and the angle of the LEDs. In this embodiment of the present invention, the LEDs (04*a*,04*b*) each have a diameter of 3–5 mm, a brightness of 200 Mcd and an angle of emission of 45 degrees. The radial holes (03*a*,03*c*) are equally spaced apart (½ inch) from each other. The scattering body (08) has a height of 14 mm and a width of 8 mm. A mediate portion (11) sandwiched between the scattering body (08) and the LEDs (04*a*,04*b*) is a portion of the cladding (09) and has a thickness (S1) of 2 mm. The arcuate top face (10) of the cladding (09) has a thickness (S2) of 2 mm.

Figure 4:
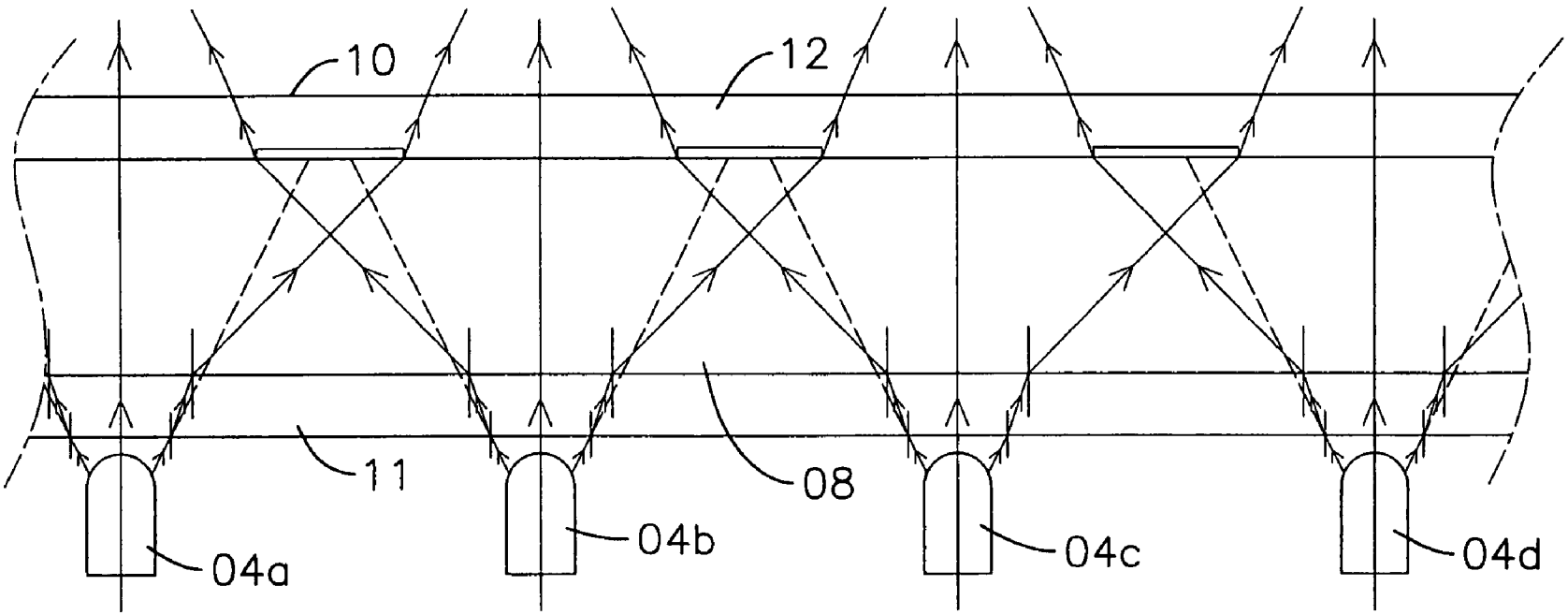
FIG. 4 is a schematic view showing the light effect from the light string of the present invention.

Referring to FIGS. 2 and 3 and with reference to FIG. 4, it is noted that the light beam from the LEDs (04*a*,04*b*) passes through the mediate portion (11), the scattering body (08) and the arcuate top face (10) such that edges of the light beams from adjacent LEDs (04*a*,04*b*) are overlapped. After the light beams from the LEDs (04*a*,04*b*) are refracted by the mediate portion (11) and the arcuate top face (10) and scattered by the scattering body (08), the overlapped effect to the edges of adjacent LEDs (04*a*,04*b*) light beams causes central regions between two adjacent LEDs (04*a*,04*b*) to have a brightness substantially the same as the brightness from the center of the LEDs (04*a*,04*b*). Therefore, it is expected that the lighting effect of the light string of the present invention is able to present a soft and continuous light beam. An electrical plug (14) is integrally formed with the connection wires (01*a*,01*b*) by a cable (13) for providing electricity to the LEDs (04*a*,04*b*) and a stopper (15) is integrally formed opposite to the electrical plug (14),however, as the plug and stopper are conventional in the art detailed descriptions thereof are thus omitted.

Figure 5:
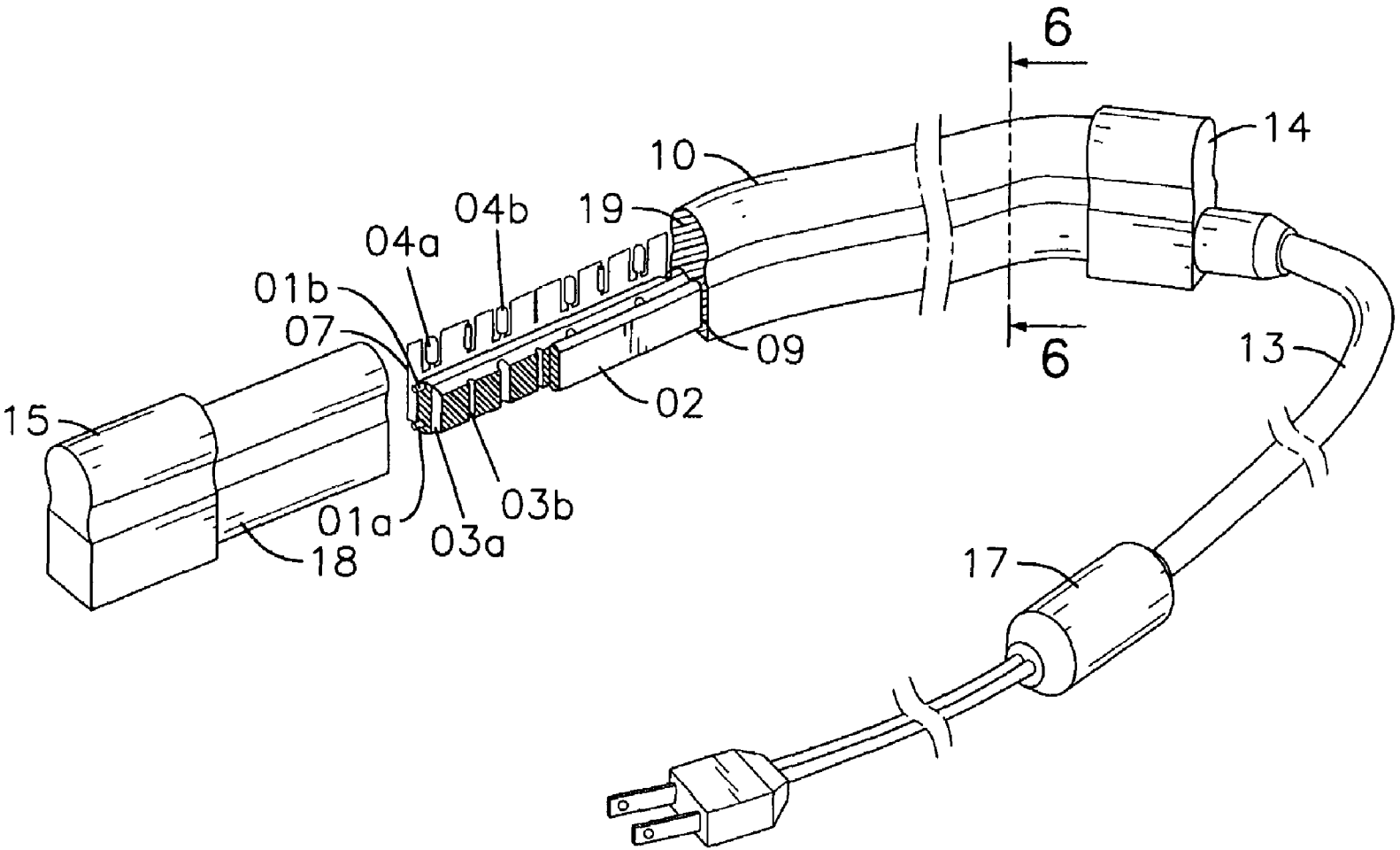
FIG. 5 is a perspective view showing the second embodiment of the light string of the present invention.
Figure 6:
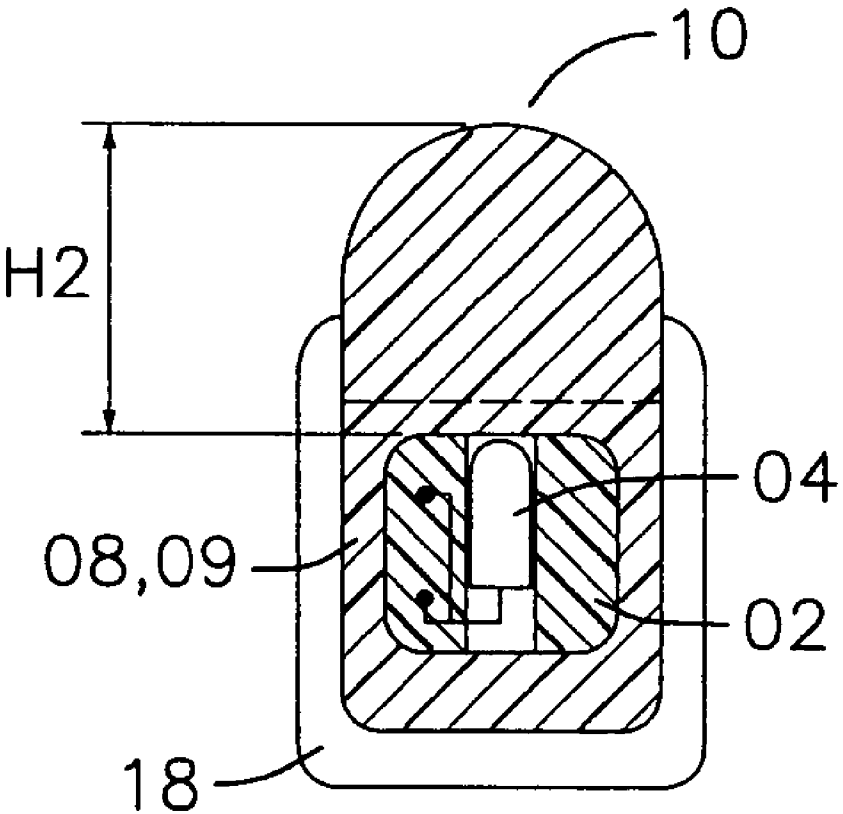
FIG. 6 is a cross sectional view of the light string in FIG. 5.

In order to enhance the lighting effect of the present invention, two opposite sides and a bottom of the cladding (09) may be coated with an opaque layer (16), as shown in FIGS. 1 and 2, preferably a black paint (18), as shown in FIGS. 5 and 6.

A converter (17), as shown in FIG. 1 is added to the light string of the present invention to change alternate current to direct current such that flashing of the LEDs is avoided and thus the LEDs are able to emit a steady and continuous light beam.

A different embodiment of the present invention is shown in FIGS. 5 and 6, wherein the scattering body (08) in the first embodiment and the cladding (09) are integrally formed into one piece. Therefore, the height (H2) of the cladding (09) on top of the printed circuit board (02) is slightly smaller than a sum of the scattering body (H), thickness (S1) of the arcuate top face (10) and the thickness of the mediate portion (11) in the embodiment in FIGS. 1 and 2 and is 16 mm. The width of the arcuate top face (10) is 8 mm.

Figure 7:
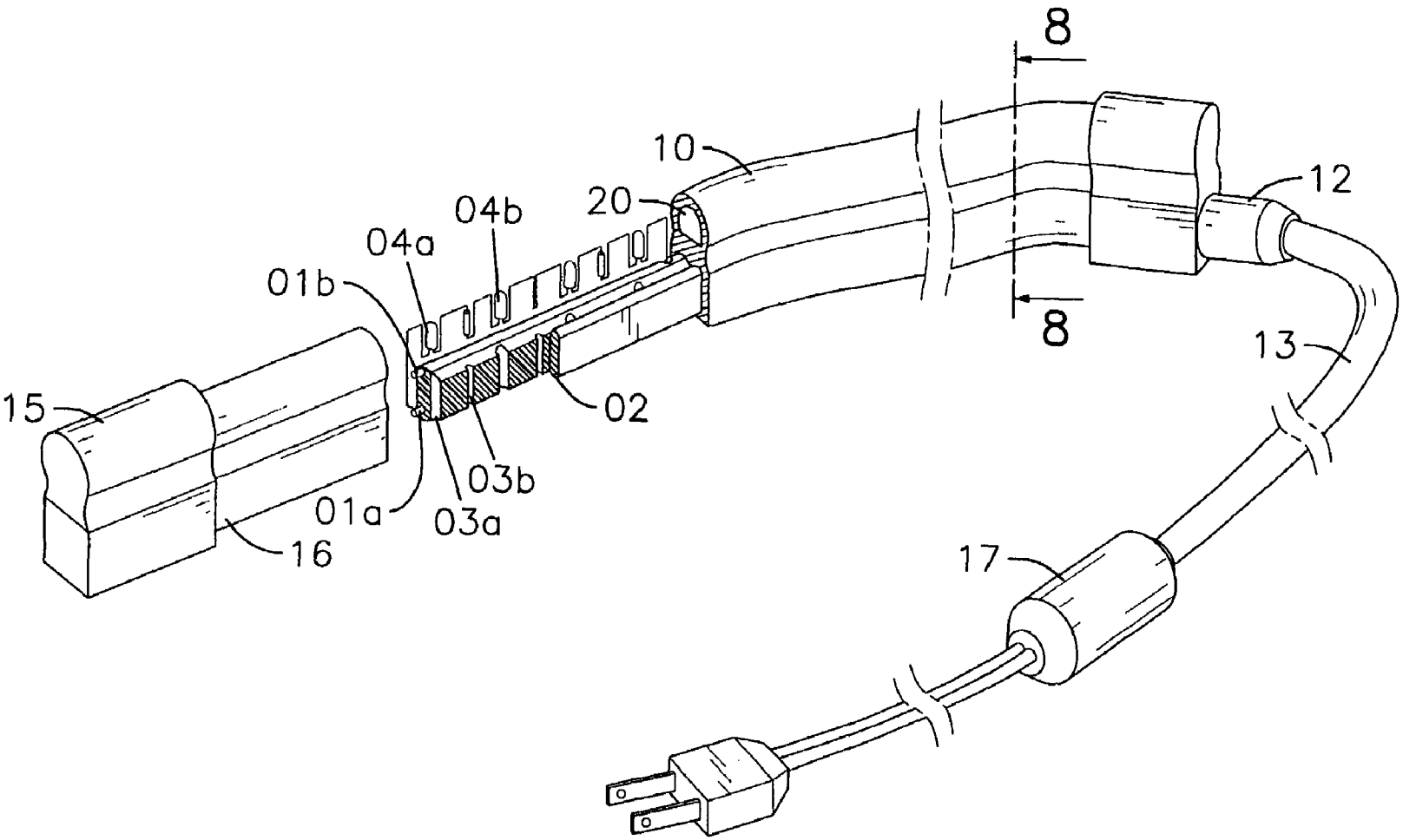
FIG. 7 is a perspective view of the third embodiment of the light string of the present invention.
Figure 8:
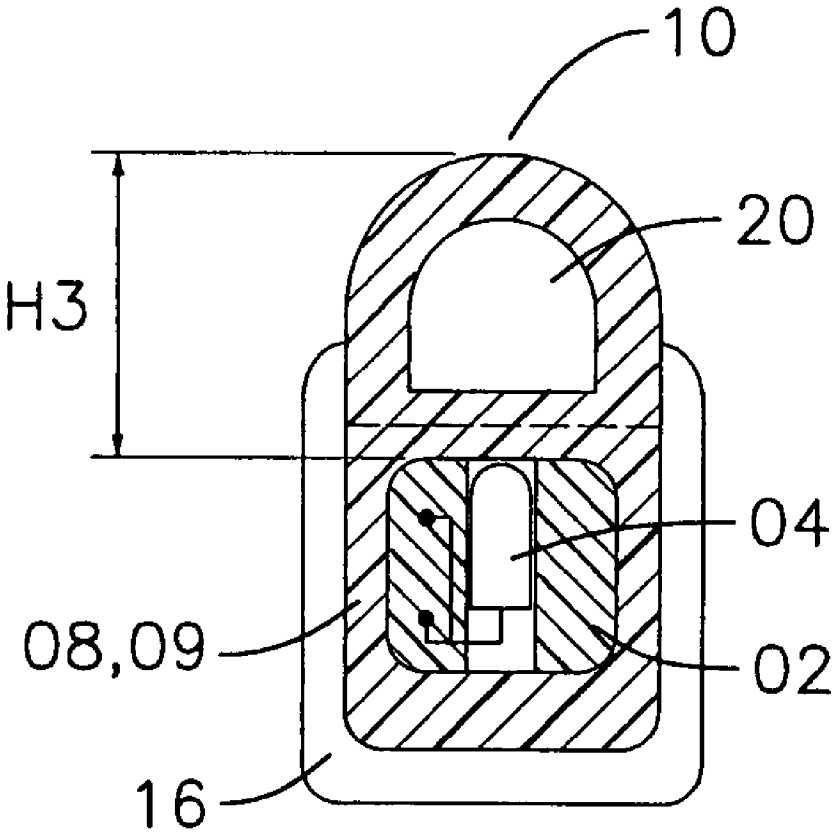
FIG. 8 is a cross sectional view of the light string in FIG. 7.

Still another embodiment is seen in FIGS. 7 and 8, wherein a passage (20) is defined in the cladding (09) on top of the printed circuit board (02). Due to the scattering effect of air inside the passage (20) being inferior to the scattering body (08) in the first embodiment, the height (H3) of the cladding (09) on top of the printed circuit board (02) should be larger than the height (H2) in the embodiment disclosed in FIGS. 5 and 6.

Figure 9:
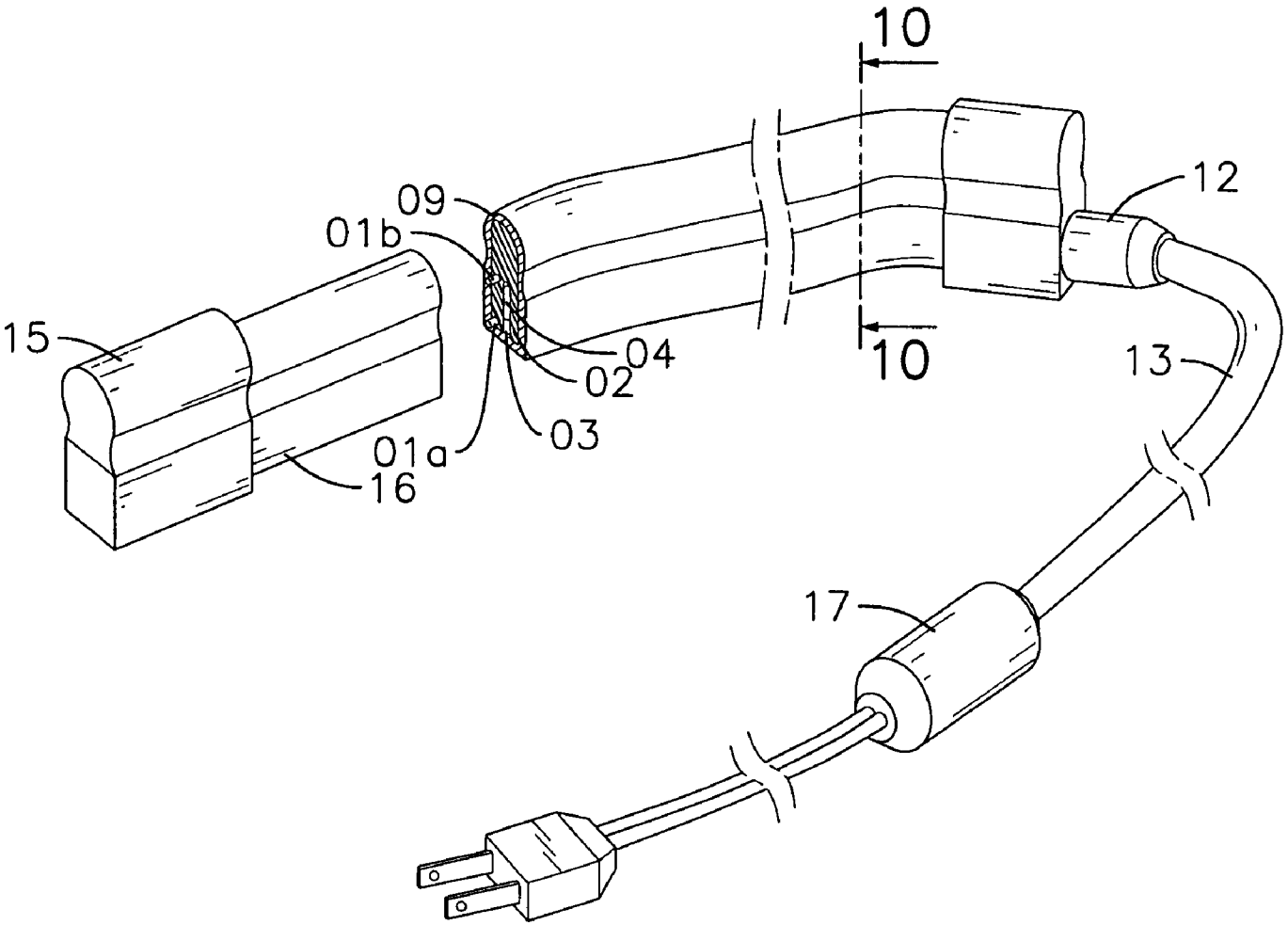
FIG. 9 is a perspective view showing another embodiment of the light string of the present invention.
Figure 10:
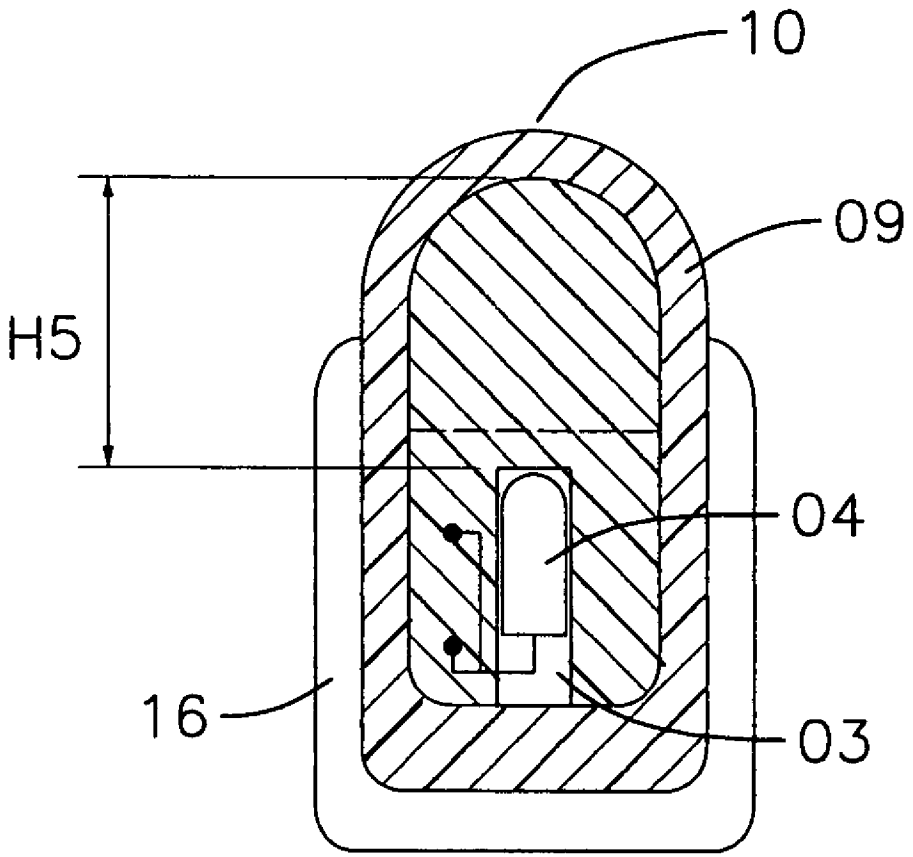
FIG. 10 is a cross sectional view of the light string in FIG. 9.

With reference to FIGS. 9 and 10, another embodiment shows that the printed circuit board (02) and the cladding (09), as shown in the previous embodiments, are integrally formed into one piece. Thereafter, axial holes (03) are spatially defined in the light string to receive therein LEDs. With the provision of the printed circuit board (02), the manufacture of the light string of the present invention is facilitated.

Figure 11:
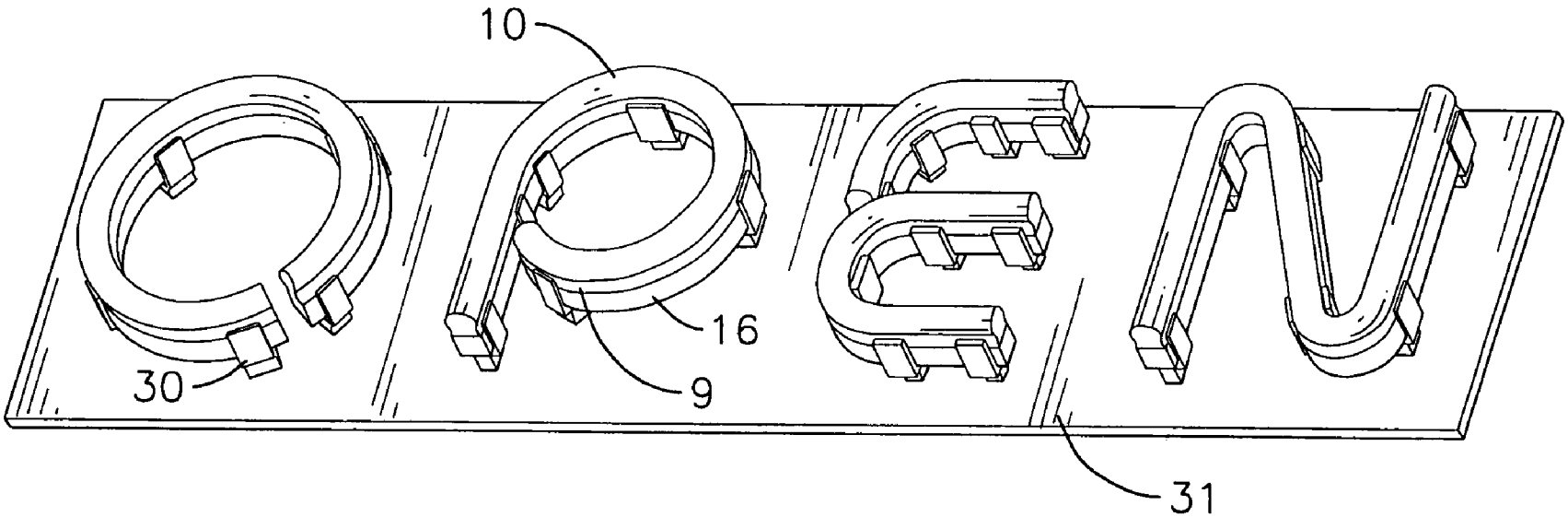
FIG. 11 is a perspective view of a conventional light string.
Figure 12:
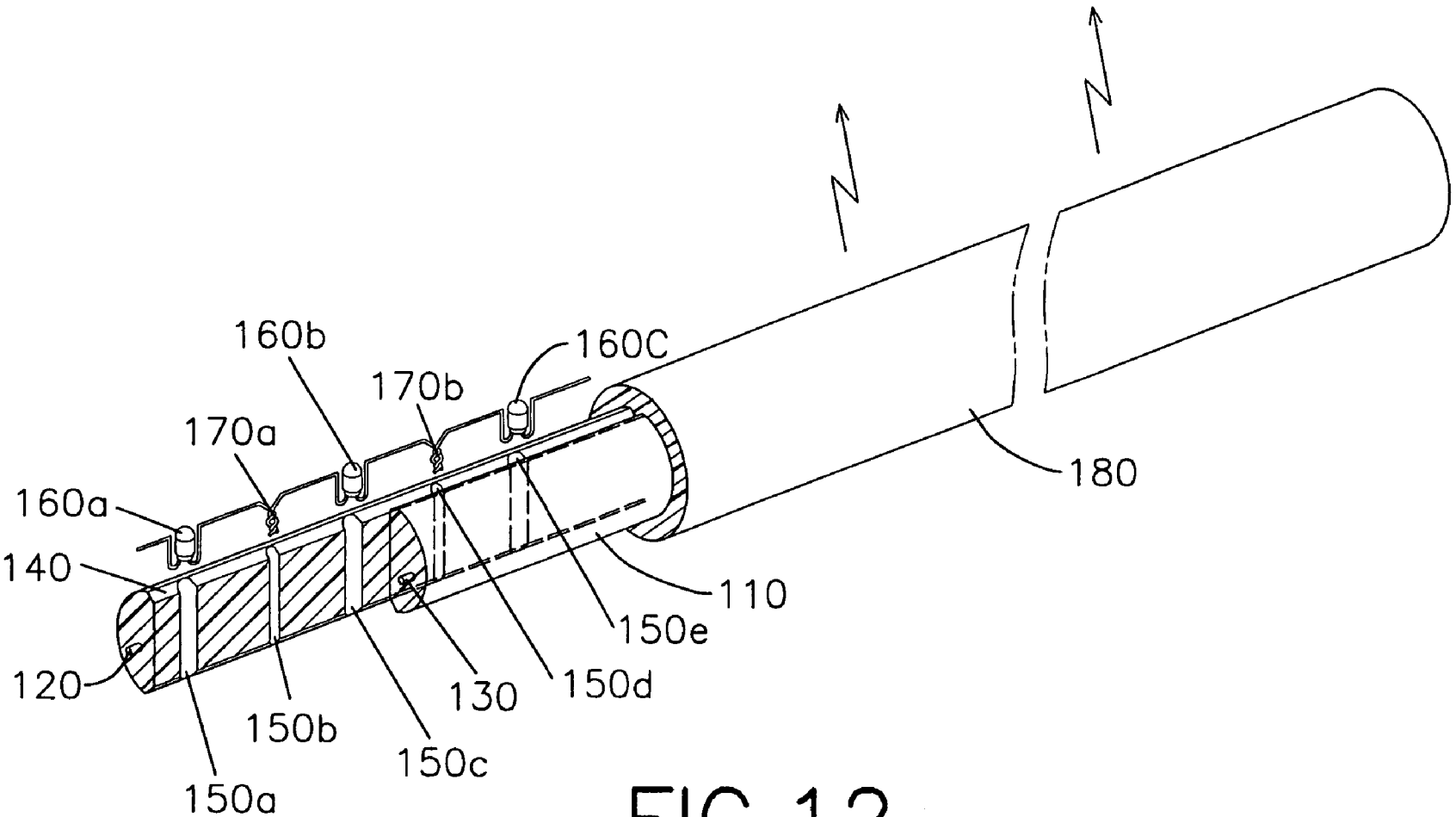
FIG.12 PRIOR ART
FIG. 12 is a schematic view showing the application of the light string of the present invention.

With reference to FIG. 11, after the light string of the present invention is formed, a clamp (30) may be applied to fasten the light string on a board (3 1). Because the opposite sides of the cladding (09) are coated with the opaque layer (16), light beams from the LEDs can only be emitted from the arcuate top face (10) of the cladding (09), which is able to emit a continuous and soft light beam the same as a neon light.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A light string comprising:

a printed circuit board made of a soft material and having multiple axial holes defined in one side of the printed circuit board;

two connection wires received in the other side of the printed circuit board to be opposite to positions of the axial holes;

multiple light emitting diodes (LEDs) respectively received in the axial holes and connected to the two connection wires for electrical connection;

a scattering body formed on top of the printed circuit board and on top of the LEDs for scattering light beams from the LEDs;

a cladding enclosing the scattering body and the printed circuit board and having an arcuate top face for emission of light beams of the LEDs;

a plug connected to a same end of the two connection wires for providing electricity to the LEDs; and a stopper connected to the cladding and further connected to the connection wires at an end distal to the end of the plug.

2. The light string as claimed in claim 1, wherein an opaque layer is formed on the cladding to stop penetration of light beams of the LEDs so as to enhance the emission of light beams out of the arcuate top face of the cladding.

3. The light string as claimed in claim 2, wherein the opaque layer is a layer of black paint.

4. The light string as claimed in claim 1 further comprising a converter to change alternate current from the plug to direct current for the LEDs.

5. The light string as claimed in claim 3 further comprising a converter to change alternate current to direct current for the LEDs.

6. The light string as claimed in claim 1, wherein the scattering body is integrally formed with the cladding.

7. The light string as claimed in claim 3, wherein the scattering body is integrally formed with the cladding.

8. The light string as claimed in claim 4, wherein the scattering body is integrally formed with the cladding.

9. The light string as claimed in claim 5, wherein the scattering body is integrally formed with the cladding.

10. The light string as claimed in claim 9, wherein the scattering body is a passage.

* * * * *